United States Patent [19]

Brendlinger

[11] 4,434,040

[45] Feb. 28, 1984

[54] VERTICAL-PASS ELECTROTREATING CELL

[75] Inventor: Edward C. Brendlinger, Pitcairn, Pa.

[73] Assignee: United States Steel Corporation, Pittsburgh, Pa.

[21] Appl. No.: 425,762

[22] Filed: Sep. 28, 1982

[51] Int. Cl.[3] ..... C25D 17/00; C25D 17/10

[52] U.S. Cl. ..... 204/206

[58] Field of Search ..... 204/206-211

[56] References Cited

U.S. PATENT DOCUMENTS

| | | | |
|---|---|---|---|
| 2,317,242 | 4/1943 | Allen | 204/206 |
| 2,673,836 | 3/1954 | Vonada | 204/28 |
| 3,471,375 | 10/1969 | Cooke | 204/206 |
| 3,616,426 | 10/1971 | Nakao | 204/207 |
| 4,118,302 | 10/1978 | Gobert | 204/206 |
| 4,132,609 | 1/1979 | Bush | 204/206 |

*Primary Examiner*—T. M. Tufariello

*Attorney, Agent, or Firm*—Arthur J. Greif

[57] ABSTRACT

The invention is directed to an electrotreating apparatus, utilizing a vertical-pass electrotreating cell wherein the strip passes over a conductor roll, through one corridor of the cell, around the sink roll, up through a second corridor of the cell and over a second conductor roll. Electrolyte is caused to flow from the lower portions of each corridor, up through the corridors and overflow into a collector tank for recycle through the system. Rather than support electrodes from the top of each corridor, electrode replacement is facilitated by inserting the electrodes through the outer walls of each of the corridors. Proper sealing of such electrodes is achieved by utilizing an electrode with a T-shape cross-section, in which the top of the T is a flange for exerting a bearing, liquid-tight sealing force against the outer surface of the corridor wall, while the vertical portion of the T comprises that part of the electrode which is inserted into a hole in the corridor wall.

5 Claims, 3 Drawing Figures

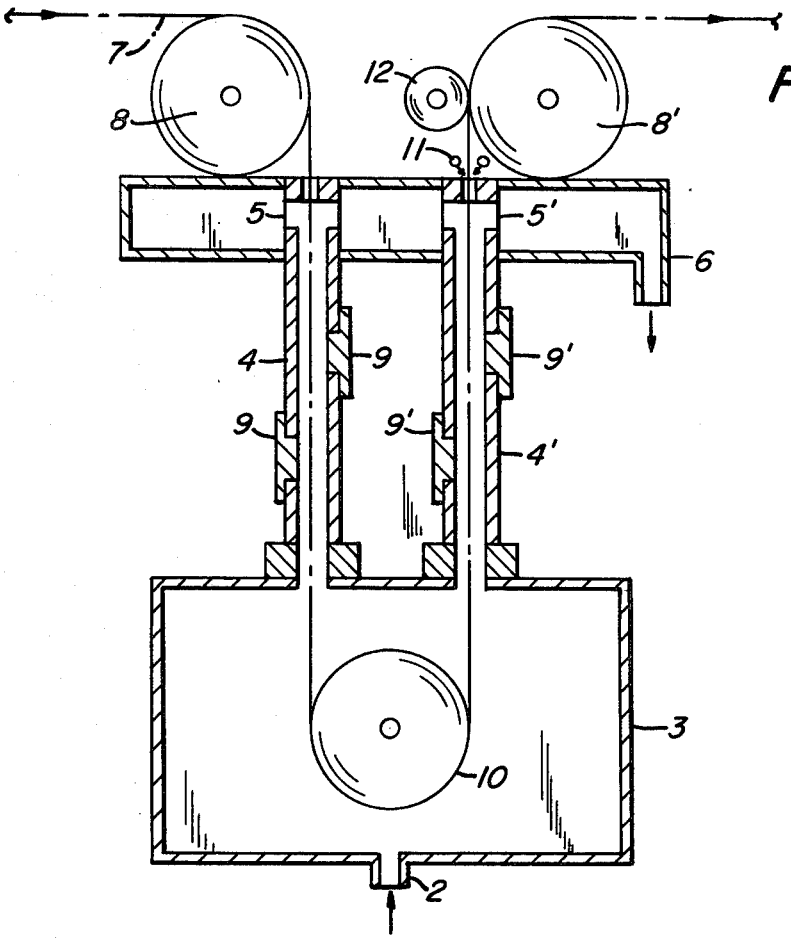
FIG. 1
FIG. 2
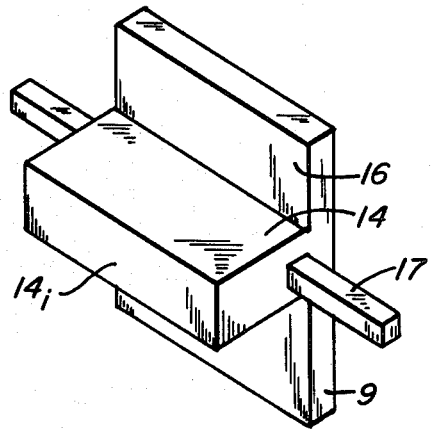
FIG. 3
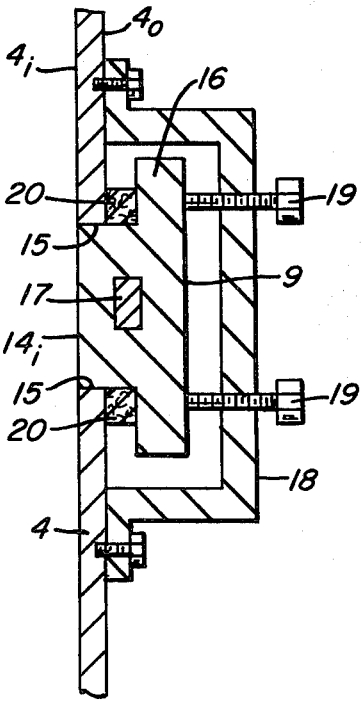

VERTICAL-PASS ELECTROTREATING CELL

This invention relates to an apparatus for electrotreating of metal strip and more particularly for electrotreating such strip in vertical passes.

In the electrotreating (e.g. plating, cleaning, pickling) of metal strip, the most widely used system employs what may be termed a "conventional" vertical pass method in which the metal strip enters a tank by passing over a roll, is fed downward through the bottom of the tank where another roll is located, is then wrapped around this bottom roll or sink roll, and fed vertically upward until it exits from the tank over a roll in the same manner as it entered. The geometry employed in such conventional vertical systems is such that a relatively great distance between the strip and the electrodes is required, thus necessitating high voltages for relatively small current densities. This, in turn, requires either extremely expensive direct current power supplies or a reduction in the amount of current utilized, consequently limiting the speed and productivity of the electrotreating process. In addition to the spacing employed, the maximum currents which can be applied are also limited by the relatively small amount of turbulence in the electrolyte, resulting in the inhibition (concentration polarization) of the rate at which the electrotreating process can be effected. To overcome these limitations of the conventional vertical cell, the art has resorted to what may be termed horizontal plating cells, see for example U.S. Pat. Nos. 3,471,375; 3,616,426 and 3,718,547, wherein the strip is passed horizontally between a pair of closely spaced electrodes housed in the tube-like conduit through which electrolyte is pumped at a high turbulence to overcome concentration polarization limitations. Such horizontal systems have overcome the above-mentioned difficulties inherent in the conventional vertical systems. Nevertheless, since such horizontal systems require a rather radical departure from the conventional vertical tanks, and require significant capital expenditures in removing the vertical tanks and installing completely new apparatus, most facilities still employ such conventional vertical pass systems. It has now been discovered that the efficiency and high production rates of the horizontal pass systems can also be achieved in a vertical pass system, somewhat analogous to that shown in U.S. Pat. Nos. 2,317,242 and 2,673,836, by a modification of the apparatus shown therein to enable the use of insoluble anodes which (i) may be accurately and closely spaced from the strip surface (e.g. about ¼ to 1½ inches) to increase the efficiency of the electrotreating process and (ii) may readily be removed, reconditioned and reinserted, so as to maintain such requisite close spacing.

The advantages of the instant invention will become more apparent from a reading of the following description when read in conjunction with the appended claims and the drawings in which:

FIG. 1 is a cross-section of the vertical electrotreating cell of this invention, showing the basic elements thereof, FIG. 2 is an enlarged perspective drawing of the T-shaped anodes shown in FIG. 1, and FIG. 3 is a cross-sectional illustration of the electrodes shown in FIG. 2, showing one means by which such electrodes may be mounted and sealably inserted into the cell wall.

As noted above, a basic deficiency of the conventional-type vertical pass electrotreating apparatus is the inability of such systems to support high current densities. This inability is the result of comparatively (i) poor electrolyte turbulence, resulting in concentration polarization—in which the regions adjacent the electrode and strip surfaces become depleted of the ions requisite for achieving the desired electrotreatment, and (ii) large spacings employed between the electrodes and the strip (necessitated by variations in the pass line of the strip, thus resulting in difficulties in controlling electrode to strip distances), thereby substantially increasing resistance of the electric path and decreasing the efficiency of process. It is well known that the limiting diffusion current density of an electrotreating reaction may be increased by increases in the temperature, concentration and solution velocity of the electrolyte. Since for any specific electrotreating process the concentration and temperature ranges are generally fixed, the most practical method for overcoming concentration polarization is by increasing solution velocity, i.e. turbulence of the electrolyte. One means for achieving such high velocities, in a vertical pass system, is by forcing the electrolyte through a restricted corridor such as shown in U.S. Pat. Nos. 2,317,242 and 2,673,836. It was found, however, while the problem of concentration polarization could be overcome by a flow system analogous to that shown in the aforementioned patents, that the means for mounting electrodes shown therein were inappropriate for achieving the close electrode-to-strip spacings requisite in processes designed for the application of high current densities. In accord with the instant invention, such vertical-pass apparatus has therefore been modified to permit the insertion of electrodes from outside the walls of the corridors through which the electrolyte passes, requiring an electrolyte overflow system which prevents contact of the electrolyte with the outside of such walls.

Referring to FIG. 1, the basic elements of the new system, analogous to the aforementioned vertical pass systems, comprise a piping system 2, which through piping from a reservoir (not shown), circulates the electrolyte in the direction of the arrows into the tank 3, up through the tube-like electrotreating corridors 4 and 4', through overflows 5 and 5', and into collector tank 6 for return to the reservoir—thereby maintaining requisite agitation and concentration of the electrolyte solution. Strip 7 enters the cell by initially being wrapped around conductor roll 8 and thereafter passing into the flow channel of corridor 4, the walls of which can be made of metal, plastic-type materials, or any other material compatible with the electrolyte being employed. On each side of the walls of the corridor is an opening wherein one or more T-shaped anodes 9 are placed, preferably in staggered relationship to those on the opposite wall. Such staggering is particularly desirable for electrodeposition processes so as to prevent one anode from plating onto the other anode. After entering tank 3, it is necessary to change the direction of the strip for passage through the next corridor. This is accomplished by sink roll 10. After its upward passage through corridor 4', any contaminants which might be dragged by the strip onto the conductor roll 8' are removed by spray headers 11. To prevent arcing from damaging the strip, hold-down roll 12 may be placed slightly below the tangent point at where the strip contacts the conductor roll.

It is well known that various alternatives are available for conducting electricity into and away from the strip. For example, if the apparatus were to be utilized solely for electrolytic cleaning or pickling, electrodes in the down-pass (or the up-pass) could be made either positive or negative with respect to the steel strip, depending on the polarity of the conductor roll which imparts the same polarity to the strip. Strip polarity can also be varied in either flow channel by varying the lead connections from the power supply. In an electroplating mode, the conductor roll and strip would be made cathodic (negative polarity) with respect to the electrodes, functioning as anodes. While the use of conductor rolls for making direct electrical contact with the strip is preferable for high current density electrotreating processes, i.e. current densities in excess of 500 amps/ft.$^2$, it should be recognized that the use of conductor rolls are not essential and that current transfer to the strip can be effected by what has been termed bipolar electrolyzing (see for example U.S. Pat. No. 2,165,326) in which transfer may be effected from an electrode of one polarity, through the electrolyte to the strip and again through the electrolyte to an electrode of opposite polarity.

Details of a preferred design for the T-shaped electrodes (9 and 9') utilized in the instant apparatus are shown in FIGS. 2 and 3. Electrode 9 comprises two main portions: (i) inner portion 14 for insertion in liquid-tight engagement with the surfaces 15 of the hole in the wall of conduit 4, and (ii) an outer, flange portion 16 for exerting a sealing force against the outer wall surface $4_o$ of the conduit wall. For more efficient current carrying ability, a bus bar, e.g. made from copper, may be integrally cast in the electrode body to enable electrical contact to be made from outside of the tank and away from possible contamination by the electrolyte. Additionally, such integral casting provides both better mechanical and electrical contact than would be achieved by the conventional manner of merely bolting the bus bar to the electrode. To prevent perturbation in the flow of the electrolyte through the flow channel of corridor 4, inner electrode face $14_i$ desirably will be designed so as to fit flush with inner wall face $4_i$. To achieve desired liquid-tight sealing, bracket 18 may be employed in conjunction with anchoring screws 19 so that flange portion 16 may be exerted to bear either (a) directly against outer wall $4_0$ (not shown) or (b) against packing 20, both to seal and insulate the flange portion from cell wall. In addition to the improved sealing, and the ease of electricl connection permitted by use of the flange portion 16, the larger, external surface also permits enhanced electrode cooling; e.g. by natural convection, with or without the use of cooling fins, or by conductive cooling with a fluid heat transfer medium.

I claim:

1. In an apparatus for the electrotreating of an extended length of metal strip comprising, two tube-like elecrolyte corridors for the passage of electrolyte therethrough, said tube-like corridors being supported, with their axes substantially vertical, above an electrolyte tank, an ingress roll over which the strip passes prior to its downward passage into the upper portion of one of said corridors, supported in said tank, a sink-roll around which the strip passes prior to its entrance into the lower portion of the second of said corridors, an egress roll over which the strip passes after its passage from the upper portion of said second corridor, means for supplying an electrotreating current to said strip, means for flowing electrolyte into the lower portions of said corridors and overflow means for carrying electrolyte from the upper portions of said corridors back to said electrolyte tank, the improvement, in which said means for supplying an electrotreating current include electrodes inserted into holes in the corridor walls and insertable from the outer surface of said walls, the outer wall surface in proximity to such electrodes being free from contact by the electrolyte, said electrodes (i) having an outer flange portion for exerting a liquid-tight sealing force against the corridor wall outer surface and (ii) an inner portion inserted into said wall holes, such that when so inserted (a) the inner electrode face will be in parallel opposition to a strip face and substantially flush with the corridor wall inner surface and (b) the horizontal electrode surface immediate to said inner electrode face is in liquid-tight engagement with the hole surface surrounding it.

2. The method of claim 1, wherein said overflow means includes piping for carrying electrolyte back to said tank while preventing contact of the electrolyte with the corridor wall outer surfaces.

3. The method of claim 2, wherein the normal distance between the corridor wall inner surfaces is within the range $\frac{1}{2}$ to 3 inches.

4. The apparatus of claim 3, in which said electrode outer flange portion and inner portion are cast an integral unit, said outer flange portion being cast around a bus-bar for contact to a terminal of a voltage source.

5. The apparatus of claim 4, in which said ingress and egress rolls are connected to a power source so as to serve as conductor rolls.

* * * * *

UNITED STATES PATENT AND TRADEMARK OFFICE

CERTIFICATE OF CORRECTION

PATENT NO. : 4,434,040

DATED : February 28, 1984

INVENTOR(S) : Edward C. Brendlinger, Richard F. Higgs, Issa J. Kharouf

It is certified that error appears in the above-identified patent and that said Letters Patent is hereby corrected as shown below:

On the title page inventors should read

-- Edward C. Brendlinger, Pitcairn, Pa.;
Richard F. Higgs, Monroeville, Pa.;
Issa J. Kharouf, Pittsburgh, Pa. --

Signed and Sealed this

*Third* Day of *July 1984*

[SEAL]

*Attest:*

GERALD J. MOSSINGHOFF

*Attesting Officer*

*Commissioner of Patents and Trademarks*